US011069495B2

(12) United States Patent
Leccia

(10) Patent No.: US 11,069,495 B2
(45) Date of Patent: Jul. 20, 2021

(54) VACUUM SWITCHING APPARATUS AND DRIVE MECHANISM THEREFOR

(71) Applicant: EATON INTELLIGENT POWER LIMITED, Dublin (IE)

(72) Inventor: Brad Robert Leccia, Bethel Park, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 16/258,033

(22) Filed: Jan. 25, 2019

(65) Prior Publication Data

US 2020/0243286 A1 Jul. 30, 2020

(51) Int. Cl.
*H01H 1/02* (2006.01)
*H01H 33/666* (2006.01)
*H01H 33/664* (2006.01)

(52) U.S. Cl.
CPC ..... *H01H 33/666* (2013.01); *H01H 1/0203* (2013.01); *H01H 33/664* (2013.01)

(58) Field of Classification Search
CPC ..... H01H 33/666; H01H 33/664; H01H 33/6664; H01H 2033/6667; H01H 1/0203; H01H 33/42; H01H 33/40; H01H 33/6662
USPC ..... 218/140, 120, 153, 154, 118
See application file for complete search history.

(56) References Cited

U.S. PATENT DOCUMENTS 3,597,556 A * 8/1971 Sharp ..... H01H 3/30 218/4
3,739,120 A * 6/1973 Starr ..... H01H 33/666 218/124
4,654,494 A * 3/1987 Wuthrich ..... H01H 33/666 200/337
5,422,450 A * 6/1995 Miyazawa ..... H01H 33/666 218/140
5,436,414 A * 7/1995 Hodkin ..... H01H 33/666 200/17 R (Continued)

FOREIGN PATENT DOCUMENTS

DE 198 08 083 C1 4/1999
WO 2014/000790 A1 1/2014

OTHER PUBLICATIONS

DE19808083 translation (original document published Apr. 29, 1999) (Year: 1999).*

(Continued)

*Primary Examiner* — William A Bolton

(74) *Attorney, Agent, or Firm* — Eckert Seamans Cherin & Mellott, LLC

(57) ABSTRACT

A drive mechanism is for a vacuum switching apparatus. The vacuum switching apparatus has a stationary contact and a movable contact structured to move into and out of engagement with the stationary contact in order to connect and disconnect power, respectively. The drive mechanism includes a drive rod structured to drive the movable contact into and out of engagement with the stationary contact, the drive rod being movable along a longitudinal axis, and a number of toggle assemblies each having a component and a biasing element coupled to the component. The component is coupled to the drive rod. The biasing element is structured to bias the drive rod in a direction not coinciding with the longitudinal axis.

15 Claims, 6 Drawing Sheets

(56) References Cited

U.S. PATENT DOCUMENTS

| | | | | |
|---|---|---|---|---|
| 5,563,390 | A * | 10/1996 | Demissy | H01H 3/30 218/140 |
| 5,834,725 | A * | 11/1998 | Clarke | H01H 33/128 218/120 |
| 5,920,051 | A * | 7/1999 | Burri | H01H 3/60 218/154 |
| 7,075,027 | B1 | 7/2006 | Fogle et al. | |
| 7,235,751 | B2 * | 6/2007 | Liljestrand | H01H 9/40 200/239 |
| 9,183,996 | B2 * | 11/2015 | Karlstrom | H01H 3/60 |
| 2014/0027404 | A1 * | 1/2014 | Wei | B81C 1/00111 216/7 |
| 2017/0154747 | A1 * | 6/2017 | Bissal | H01H 3/28 |

OTHER PUBLICATIONS

Peng Chang et al, "A Fast Mechanical Switch for Medium-Voltage Hybrid DC and AC Circuit Breakers", IEEE Transactions on Industry Applications, IEEE Service Center, Piscataway, NJ, US, vol. 52, No. 4, Jul. 1, 2016, 8 pages.

European Patent Office, "International Search Report and Written Opinion", for corresponding International Application No. PCT/EP2020/025027, dated Jul. 1, 2020.

* cited by examiner

VACUUM SWITCHING APPARATUS AND DRIVE MECHANISM THEREFOR

BACKGROUND

Field

The disclosed concept relates generally to electrical switching apparatus such as, for example, vacuum switching apparatus. The disclosed concept also relates to drive mechanisms for vacuum switching apparatus.

Background Information

Electrical switching apparatus for electrical systems have to be able to disconnect electrical faults. For high voltage, and high and fast-rising short-circuit current, fast current interruption is generally necessary. Two technologies commonly employed for fast and reliable switching are the arc extinguishing media and the actuator. Vacuum circuit interrupters, for example, have the advantages of being relatively green, reliable, and low cost. Thomson coil based electromagnetic actuators have the advantages of being fast in terms of opening operation, fewer moving parts and good reliability. Next generation electrical switching apparatus such as, for example, vacuum circuit breakers, employ Thomson coils to achieve actuating separable electrical contacts inside a vacuum bottle for challenging circuit protection needs in high voltage and current applications such as HVDC circuit and generator breakers. Specifically, the Thomson coil drives the drive rods up and down, which in turn, allows a movable electrical contact of the electrical switching apparatus to move into and out of engagement with a stationary electrical contact.

One area of desired improvement in vacuum switching apparatus, for example and without limitation, is with respect to opening times. Known vacuum switching apparatus commonly employ contact springs to provide a contact force on the separable contacts. However, when the vacuum switching apparatus is opened, these contact springs must be un-compressed before the separable contacts disengage. For example, FIG. 1 shows a prior art vacuum switching apparatus 2 having a stationary contact 4, a movable contact 6, a drive rod 8 structured to drive the movable contact 6 into and out of engagement with the stationary contact 4, and a contact spring 10 for providing a contact force on the contacts 4,6. As shown, the contact spring 10 is in-line with the drive rod 8 and is in a compressed position. During opening of the contacts 4,6, the contact spring 10 must be uncompressed. Compare, for example, the position of the contact spring 10 in FIGS. 1 and 2. Moreover, during opening this change in position of the contact spring 10 must occur before the movable contact 6 moves away from the stationary contact 4. This undesirably adds to the opening time.

It is therefore desirable to provide for an improved vacuum switching apparatus and drive mechanism therefor.

SUMMARY

These needs and others are met by embodiments of the invention, which are directed to an improved vacuum switching apparatus and drive mechanism therefor.

As one aspect of the disclosed concept, a drive mechanism for a vacuum switching apparatus is provided. The vacuum switching apparatus has a stationary contact and a movable contact structured to move into and out of engagement with the stationary contact in order to connect and disconnect power, respectively. The drive mechanism comprises a drive rod structured to drive the movable contact into and out of engagement with the stationary contact, the drive rod being movable along a longitudinal axis, and a number of toggle assemblies each having a component and a biasing element coupled to the component. The component is coupled to the drive rod. The biasing element is structured to bias the drive rod in a direction not coinciding with the longitudinal axis.

As another aspect of the disclosed concept, a vacuum switching apparatus comprises a stationary contact, a movable contact structured to move into and out of engagement with the stationary contact in order to connect and disconnect power, respectively, and a drive mechanism. The drive mechanism comprises a drive rod structured to drive the movable contact into and out of engagement with the stationary contact, the drive rod being movable along a longitudinal axis, a Thomson coil structured be actuated, the Thomson coil being coupled to the drive rod, and a number of toggle assemblies each comprising a component and a biasing element coupled to the component. The component is coupled to the drive rod. The biasing element is structured to bias the drive rod in a direction not coinciding with the longitudinal axis.

As another aspect of the disclosed concept, a vacuum switching apparatus comprises an enclosure, a stationary contact, a movable contact structured to move into and out of engagement with the stationary contact in order to connect and disconnect power, respectively, and a drive mechanism. The drive mechanism comprises a drive rod, a Thomson coil coupled to the drive rod and being structured to be actuated, and a number of toggle assemblies each comprising a component and a biasing element coupled to the component. The component is coupled to the drive rod. The biasing element is structured to bias the drive rod. The stationary contact, the movable contact, and the drive mechanism are enclosed by the enclosure. Upon actuation the Thomson coil is structured to drive the drive rod, thereby moving the movable contact out of engagement with the stationary contact in less than 0.5 milliseconds after the Thomson coil is initially actuated.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the singular form of "a", "an", and "the" include plural references unless the context clearly dictates otherwise. Still further, as used herein, the term "number" shall mean one or an integer greater than one (e.g., a plurality).

As employed herein, the term "coupled" shall mean that two or more parts are joined together directly or joined through one or more intermediate parts. Furthermore, as employed herein, the phrase "directly coupled" shall mean that two or more parts are joined together directly, without any intermediate parts being disposed therebetween at the point or location of the connection.

As employed herein, the phrase "not coinciding" shall mean not parallel to, offset from, and at an angle with respect to.

Figure 2:
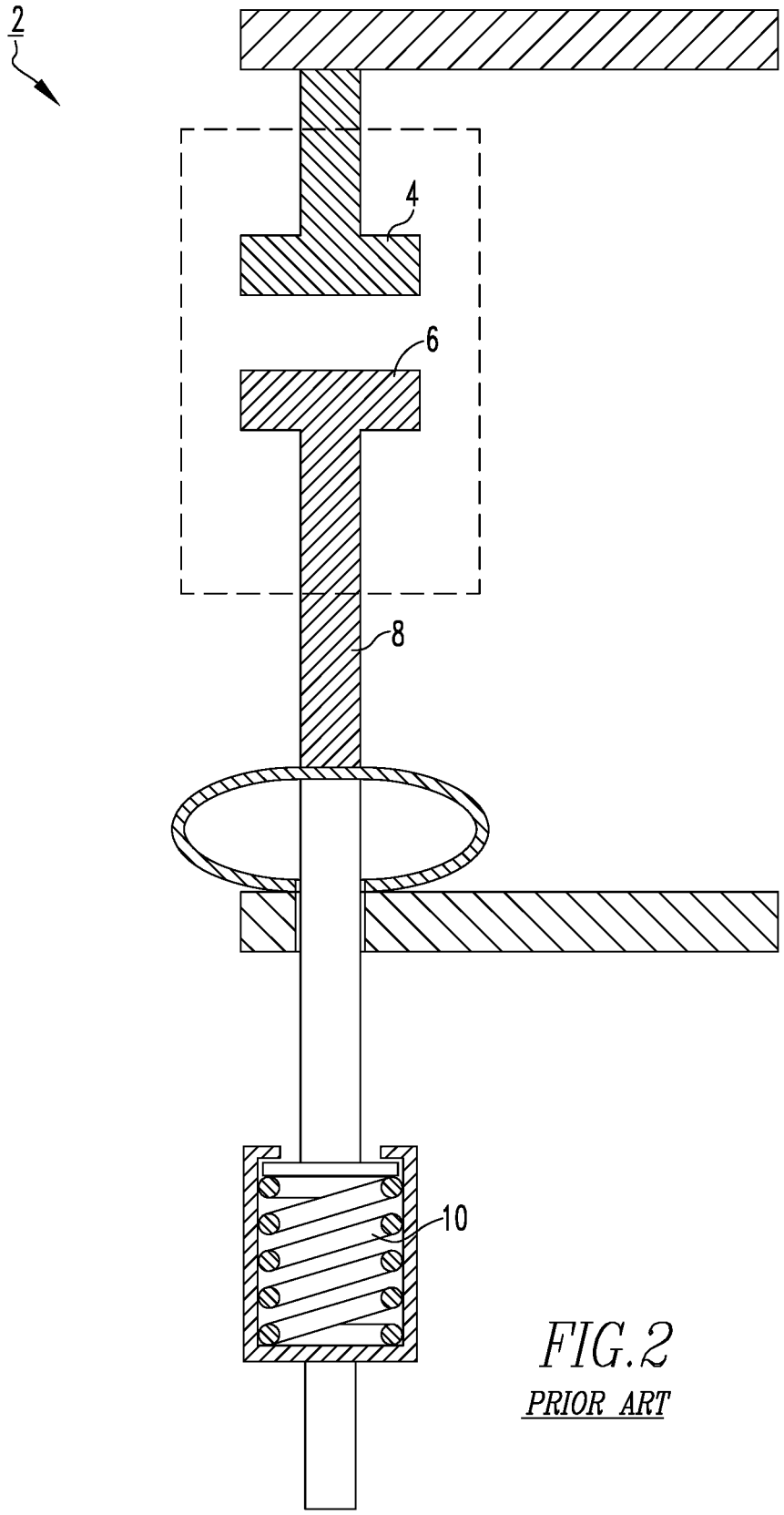
FIG.2 PRIOR ART
FIG. 2 is a schematic view of the prior art vacuum switching apparatus of FIG. 1, shown with the separable contacts in the open position.
Figure 3:
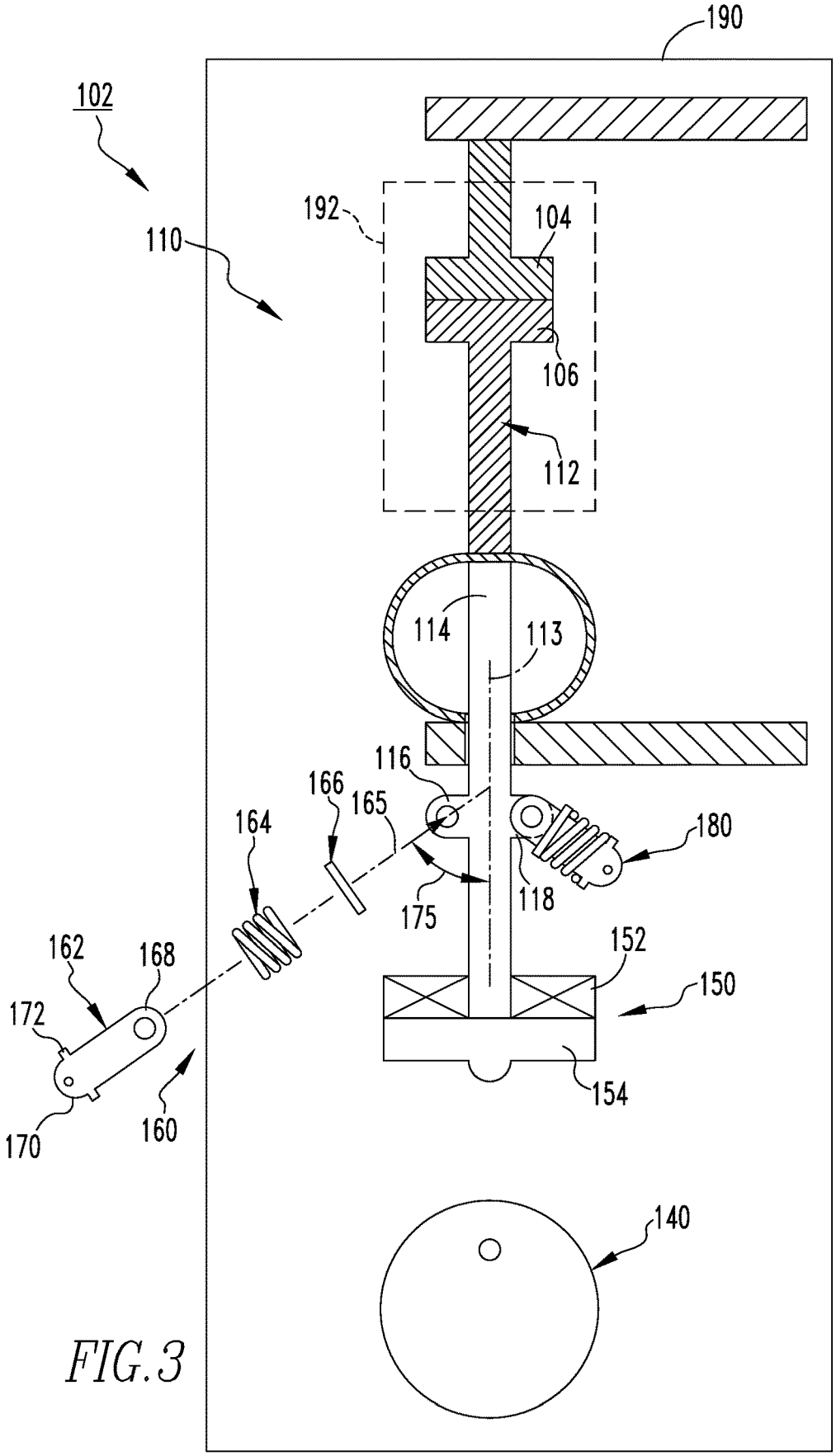
FIG. 3 is a partially exploded schematic view of a vacuum switching apparatus and drive mechanism therefor, shown with separable contacts in the closed position, in accordance with a non-limiting embodiment of the disclosed concept.

FIG. 3 is a schematic view of a vacuum switching apparatus 102, in accordance with one non-limiting embodiment of the disclosed concept. The vacuum switching apparatus 102 has a stationary contact 104, a movable contact 106, and a drive mechanism 110. In one example embodiment, the vacuum switching apparatus 102 further includes an enclosure 190 (shown in simplified form) and a tubular ceramic member 192 (shown in simplified form in dashed line drawing). As will be discussed in greater detail below, the drive mechanism 110 advantageously allows the movable contact 106 to separate (e.g., disengage) from the stationary contact 104 in significantly less time, as compared to prior art vacuum switching apparatus (e.g., the vacuum switching apparatus 2 in FIGS. 1 and 2).

In one example embodiment, the drive mechanism 110 includes a drive rod 112, a cam 140, a Thomson coil 150, and a number of toggle assemblies 160,180. The cam 140 may be coupled to the enclosure 190. The Thomson coil 150 includes a coil member 152 and a disc member 154. The disc member 154 is coupled to the drive rod 112 and is structured to be driven by the coil member 152 when the Thomson coil 150 is actuated. The drive rod 112 drives the movable contact 106 into and out of engagement with the stationary contact 104. Furthermore, the drive rod 112 is movable along a longitudinal axis 113.

For economy of disclosure, only the toggle assembly 160 will be discussed in detail herein, although it will be appreciated that each of the toggle assemblies 160,180 may be structured and configured the same. Additionally, it will be appreciated that a drive mechanism in accordance with the disclosed concept may have any suitable alternative number of toggle assemblies, without departing from the scope of the disclosed concept. The toggle assembly 160 has a component 162 extending outwardly from and coupled to the drive rod 112, a biasing element (e.g., without limitation, compression spring 164) coupled to the component 162, and optionally a plate member 166 coupled to the component 162. The component 162 has a first end portion 168, a second end portion 170 located opposite and distal the first end portion 168, and a retention portion 172 located proximate the second end portion 170. It will be appreciated that the first end portion 168 is coupled to the drive rod 112. Specifically, the drive rod 112 has an elongated body portion 114 and a number of tab portions 116,118 extending outwardly therefrom. Accordingly, in one example embodiment the first end portion 168 of the component 162 is pivotably coupled to the first tab 116 of the drive rod 112. Additionally, the component 162 may extend through the spring 164 and the plate member 166, such that the spring 164 biases the drive rod 112. In order for the spring 164 to perform this function, the plate member 166 is located between the first end portion 168 and the spring 164. As shown, in the position depicted in FIG. 3, the spring 164 biases the drive rod 112 in a direction 165 not coinciding with the longitudinal axis 113 of the drive rod 112. The purpose of this configuration will be apparent when reference is made to FIGS. 4 and 5.

During opening and closing of the vacuum switching apparatus 102, the toggle assemblies 160,180 are structured to pivot. In one example embodiment, the second end portion 170 is pivotably coupled to the enclosure 190. However, it will be appreciated that the second end portion 170 may be pivotably coupled to a suitable alternative structure (e.g., without limitation, a portion of the Thomson coil 150). Accordingly, the component 162 pivots about the second end portion 170 when the drive rod 112 drives the movable contact 106 into and out of engagement with the stationary contact 104.

Figure 4:
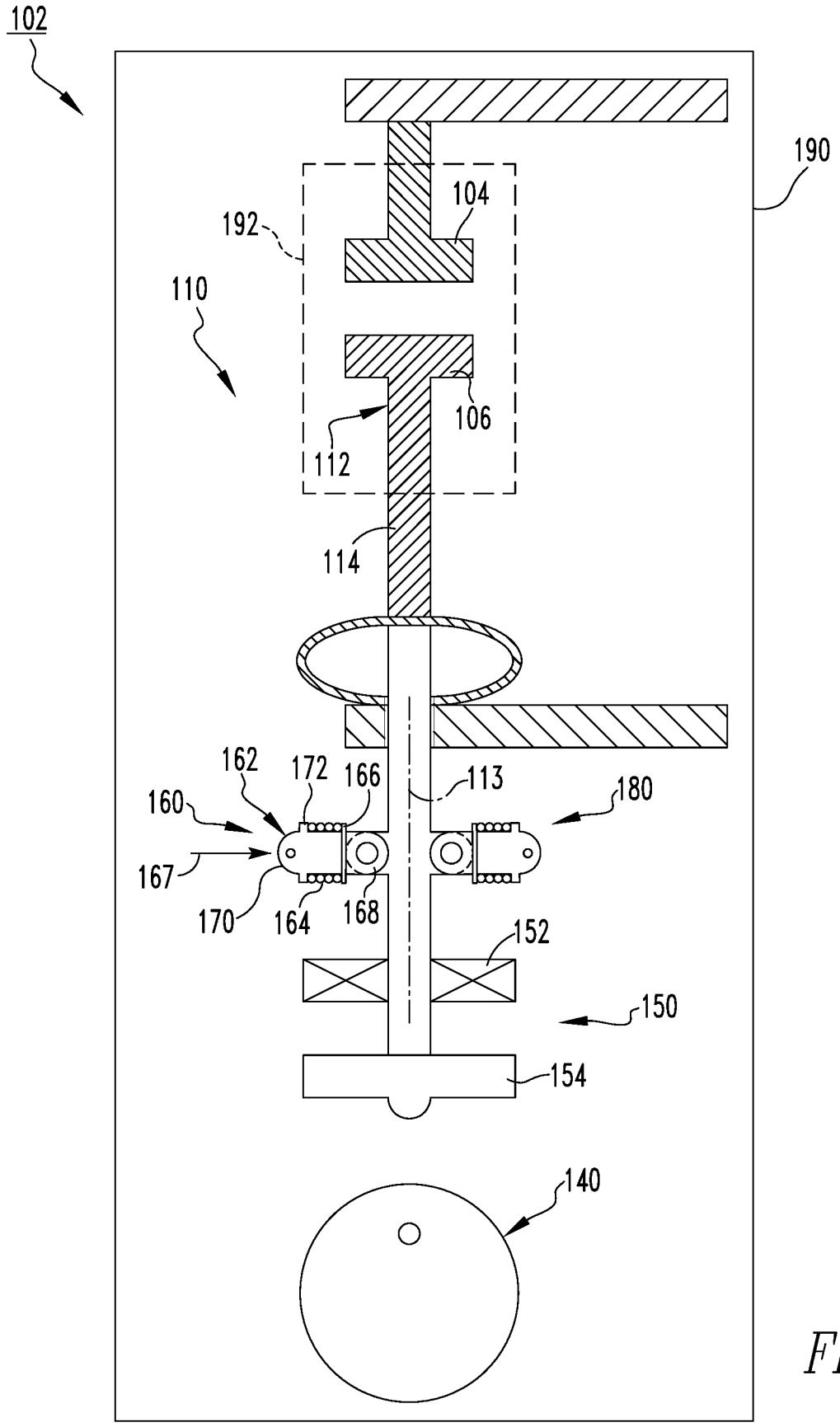
FIG. 4 is another schematic view of the vacuum switching apparatus and drive mechanism therefor of FIG. 3, shown with the separable contacts partially having been opened.
Figure 5:
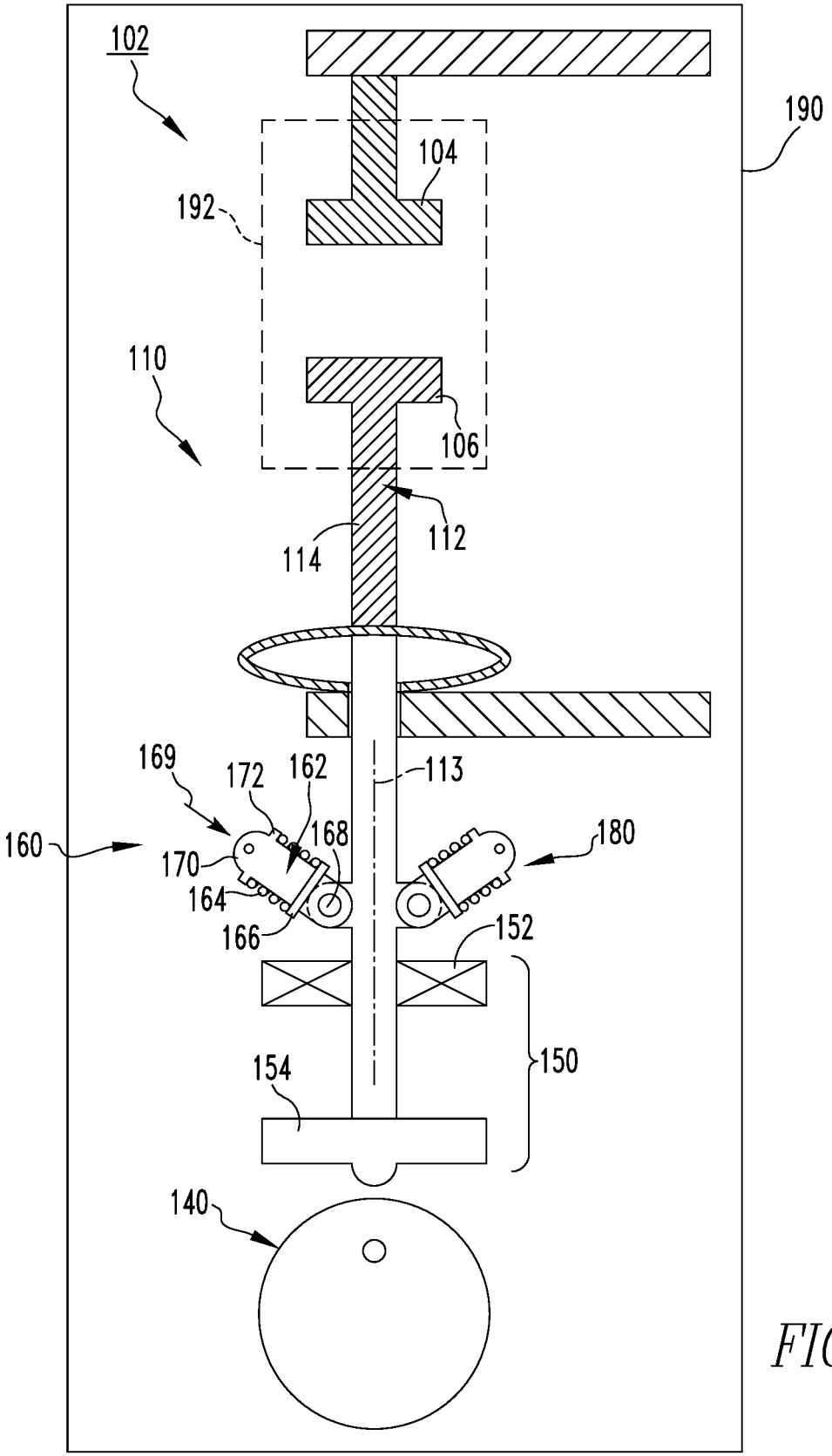
FIG. 5 is another schematic view of the vacuum switching apparatus and drive mechanism therefor of FIG. 4, shown with the separable contact fully opened.

Referring to FIGS. 3-5, the drive rod 112 has a number of positions. Specifically, the drive rod 112 has a first position (FIG. 3) corresponding to the movable contact 106 engaging the stationary contact 104, a second position (FIG. 5) corresponding to the movable contact 106 being disengaged with the stationary contact 104, and a third position (FIG. 4) between the first and second positions. As shown in FIG. 4, when the drive rod 112 is in the third position, the spring 164 biases the drive rod 112 in a direction 167 perpendicular to the longitudinal axis 113. Accordingly, when the drive rod 112 is in the first position (FIG. 3), the spring 164 biases the drive rod 112 toward the first position, and when the drive rod 112 is in the second position (FIG. 5), the spring 164 biases the drive rod 112 toward the second position.

As mentioned above, the spring 164 biases the drive rod 112 in a direction (e.g., without limitation, directions 165, 167,169 shown in FIGS. 3-5, respectively) not coinciding with the longitudinal axis 113 of the drive rod. In the example of FIG. 3, the spring 164 (e.g., see direction 165) is at an angle of incidence 175 of between 30 degrees and 60 degrees with respect to the longitudinal axis 113. Accordingly, the direction 165 of the force of the spring 164 has a horizontal component and a vertical component. The vertical component is directed upwards, thereby providing a contact force on the separable contacts 104,106. However, the spring 164, unlike prior art springs in vacuum switching apparatus, is offline from the direction of movement of the drive rod 112. This is evident by the horizontal component of the force vector of the spring 164, e.g., the spring 164 partially biases the drive rod 112 to the right. As such, the separable contacts 104,106 in accordance with the instant disclosed concept are directly and relatively rigidly coupled to the Thomson coil 150, thus allowing the separable contacts 104,106 to move at substantially the same time as the Thomson coil 150. Further yet, as a result of this configuration, during opening of the separable contacts 104,106, the movable contact 106 is advantageously able to move away from the stationary contact 104 without first having to wait for a change in position of any biasing element. Compare, for example, FIGS. 1 and 2 in which the movable contact 6 is not able to move away from the stationary contact 4 until the spring 10 moves to an uncompressed state. Thus, in one example embodiment, upon actuation of the Thomson coil 150, the Thomson coil 150 is structured to drive the drive rod 112 and move the movable contact 106 out of engagement with the stationary contact 104 in less than 0.5 milliseconds after the Thomson coil 150 is initially actuated. In other words, the drive mechanism 110 provides for a beneficial reduction in opening time of the separable contacts 104,106.

Referring again to FIGS. 3-5, the toggle assemblies 160,180 further function to provide the vacuum switching apparatus 102 with a positive stop. More specifically, when the drive rod 112 moves from the first position (FIG. 3) to the second position (FIG. 5), the component 162 remains coupled to the drive rod 112 in order to prevent the drive rod 112 from moving beyond the second position. Stated differently, because the component 162 is anchored at the second end portion 170, e.g., optionally to the enclosure 190, once the drive rod 112 has been driven down (from the perspective of FIGS. 3-5) a predetermined distance, the component 162 prevents the drive rod 112 from moving down further.

Figure 6:
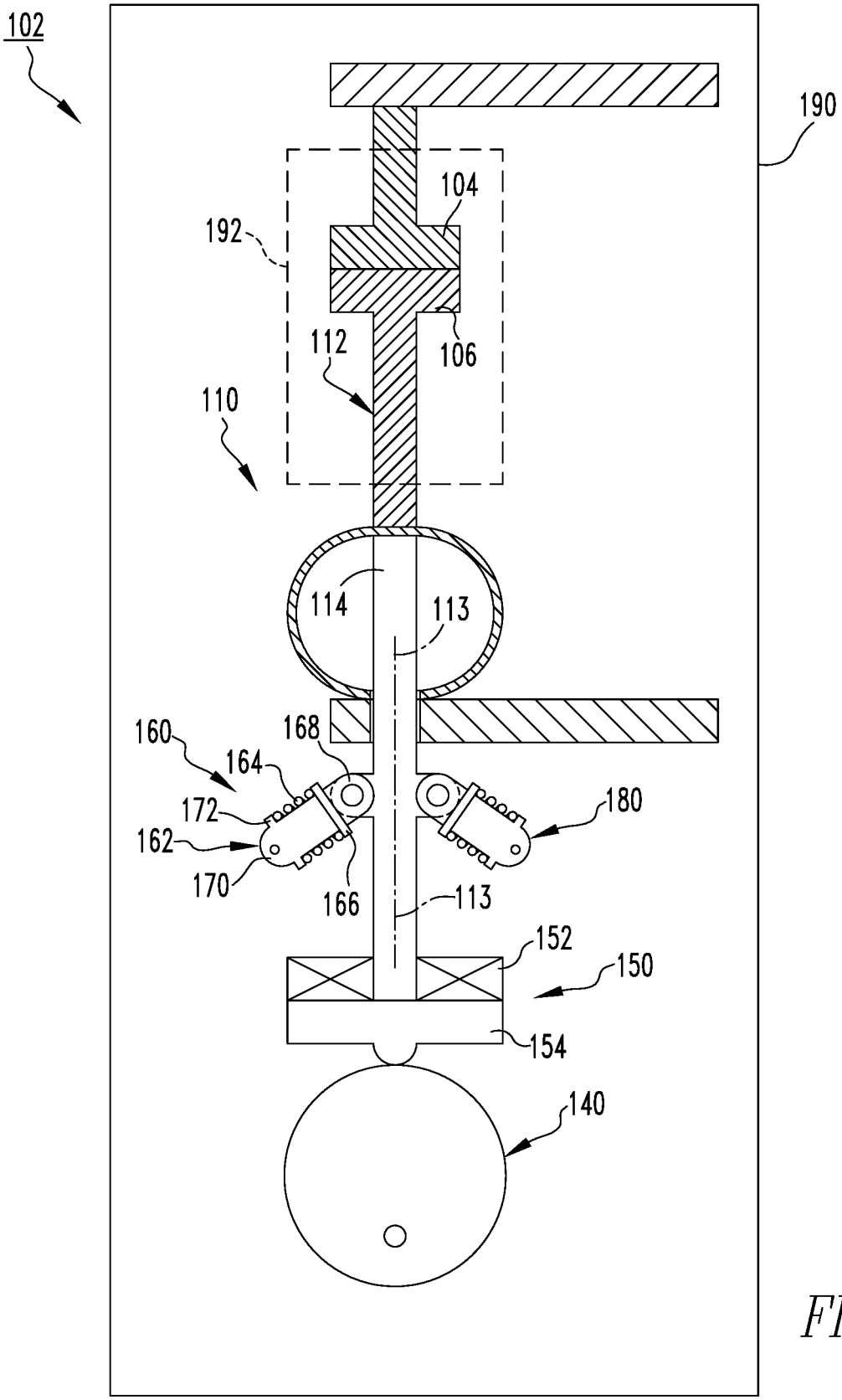
FIG. 6 is another schematic view of the vacuum switching apparatus and drive mechanism therefor of FIG. 5, shown with the separable contacts returned to the closed position.

Closing of the vacuum switching apparatus 102 will be discussed in association with FIGS. 5 and 6. It will be appreciated that in order to close the separable contacts 104,106, the cam 140 preferably rotates. Comparing FIGS. 5 and 6, the cam 140 has rotated approximately 180 degrees, and in doing so, has driven the disc member 154 and drive rod 112 upwards, thereby moving the movable contact 106 into engagement with the stationary contact 104. Furthermore, continued rotation of the cam 140 from the position depicted in FIG. 6 returns the vacuum switching apparatus 102 to the first position depicted in FIG. 3.

Figure 1:
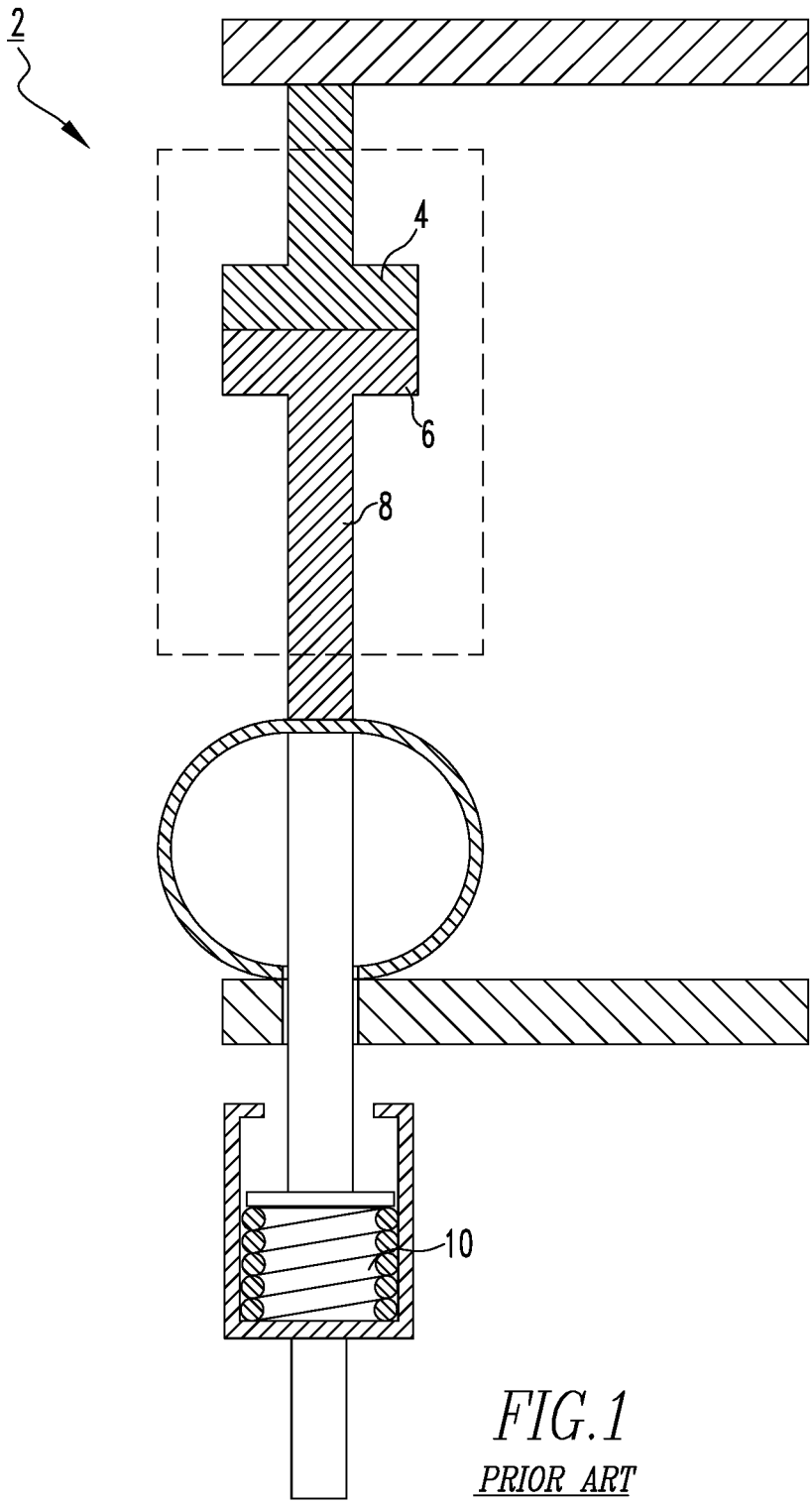
FIG.1 PRIOR ART
FIG. 1 is a schematic view of a prior art vacuum switching apparatus, shown with separable contacts in the closed position.

Accordingly, it will be appreciated that the disclosed concept provides for an improved (e.g., without limitation, faster in terms of opening time) vacuum switching apparatus 102 and drive mechanism 110 therefor, in which a number of toggle assemblies 160,180 advantageously allow the vacuum switching apparatus 102 to be opened in significantly less time, as compared to prior art vacuum switching apparatus (e.g., vacuum switching apparatus 2, shown in FIGS. 1 and 2).

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A drive mechanism for a vacuum switching apparatus, said vacuum switching apparatus comprising a stationary contact and a movable contact structured to move into and out of engagement with said stationary contact in order to connect and disconnect power, respectively, said drive mechanism comprising:

a drive rod structured to drive said movable contact into and out of engagement with said stationary contact, said drive rod being movable along a longitudinal axis; and a pair of toggle assemblies coupled to opposite sides of said drive rod and each comprising a component and a biasing element coupled to said component, said component being coupled to said drive rod, said biasing element being structured to apply a bias to said drive rod in a direction not coinciding with the longitudinal axis, wherein said drive rod has a first position corresponding to said movable contact engaging said stationary contact and a second position corresponding to said movable contact being disengaged with said stationary contact; and wherein, when said drive rod moves from the first position to the second position, said component remains coupled to said drive rod in order to prevent said drive rod from moving beyond the second position, wherein, when said drive rod is in each of the first position and the second position, each biasing element is disposed at an angle incidence of between 30 degrees and 60 degrees with respect to the longitudinal axis; and wherein each said component comprises a first end portion and a second end portion disposed opposite and distal the first end portion; wherein the first end portion is coupled to said drive rod; and wherein said component pivots about the second end portion when said drive rod drives said movable contact into and out of engagement with said stationary contact;

wherein each of said pair of toggle assemblies further comprises a plate member coupled to said component and disposed between the first end portion and said biasing element in order to allow said biasing element to bias said drive rod;

wherein said biasing element is a spring; and wherein said component extends through said spring and said plate member.

2. The drive mechanism of claim 1 wherein said spring is a compression spring.

3. The drive mechanism of claim 1 wherein said drive rod comprises an elongated body portion and a tab portion extending outwardly from said body portion; and wherein said component is coupled to said tab portion.

4. The drive mechanism of claim 1 wherein said drive rod has a third position between the first and second positions; and wherein, when said drive rod is in the third position, the direction along which each said biasing element applies the bias to said drive rod is perpendicular to the longitudinal axis.

5. The drive mechanism of claim 4 wherein, when said drive rod is in the first position, each said biasing element biases said drive rod toward the first position.

6. The drive mechanism of claim 5 wherein, when said drive rod is in the second position, each said biasing element biases said drive rod toward the second position.

7. The drive mechanism of claim 1 wherein each said component extends outwardly from said drive rod.

8. A vacuum switching apparatus comprising:

a stationary contact;

a movable contact structured to move into and out of engagement with said stationary contact in order to connect and disconnect power, respectively; and a drive mechanism comprising:

a drive rod structured to drive said movable contact into and out of engagement with said stationary contact, said drive rod being movable along a longitudinal axis, a Thomson coil structured be actuated, said Thomson coil being coupled to said drive rod, and a pair of toggle assemblies coupled to opposite sides of said drive rod and each comprising a component and a biasing element coupled to said component, said component being coupled to said drive rod, said biasing element being structured to apply a bias to said drive rod in a direction not coinciding with the longitudinal axis, wherein said drive rod has a first position corresponding to said movable contact engaging said stationary contact and a second position corresponding to said movable contact being disengaged with said stationary contact; and wherein, when said drive rod moves from the first position to the second position, said component remains coupled to said drive rod in order to prevent said drive rod from moving beyond the second position, wherein, when said drive rod is in each of the first position and the second position, each biasing element is disposed at an angle of incidence of between 30 degrees and 60 degrees with respect to the longitudinal axis; and wherein each said component comprises a first end portion and a second end portion disposed opposite and distal the first end portion; wherein the first end portion is coupled to said drive rod; and wherein said component pivots about the second end portion when said drive rod drives said movable contact into and out of engagement with said stationary contact;

wherein each of said pair of toggle assemblies further comprises a plate member coupled to said component and disposed between the first end portion and said biasing element in order to allow said biasing element to bias said drive rod;

wherein said biasing element is a spring; and wherein said component extends through said spring and said plate member.

9. The vacuum switching apparatus of claim 8 wherein said Thomson coil is structured to be actuated; and wherein, upon actuation said Thomson coil is structured to drive said drive rod, thereby moving said movable contact out of engagement with said stationary contact in less than 0.5 milliseconds after said Thomson coil is initially actuated.

10. The vacuum switching apparatus of claim 8 wherein each said component comprises a first end portion and a second end portion disposed opposite and distal the first end portion; wherein the first end portion is coupled to said drive rod; and wherein said component pivots about the second end portion when said drive rod drives said movable contact into and out of engagement with said stationary contact.

11. The vacuum switching apparatus of claim 8 wherein said biasing element is a compression spring; and wherein said component extends through said compression spring.

12. A vacuum switching apparatus comprising:

an enclosure;

a stationary contact;

a movable contact structured to move into and out of engagement with said stationary contact in order to connect and disconnect power, respectively; and a drive mechanism comprising:

a drive rod, a Thomson coil coupled to said drive rod and being structured to be actuated, and a pair of toggle assemblies coupled to opposite sides of said drive rod and each comprising a component and a biasing element coupled to said component, said component being coupled to said drive rod, said biasing element being structured to bias said drive rod, wherein said drive rod has a longitudinal axis, a first position corresponding to said movable contant engaging said stationary contact, and a second position corresponding to said movable contact being disengaged with said stationary contact, wherein, when said drive rod is in each of the first position and the second position, each biasing element is disposed at an angle of incidence of between 30 degrees and 60 degrees with respect to the longitudial axis;

wherein said stationary contact, said movable contact, and said drive mechanism are enclosed by said enclosure, wherein, upon actuation said Thomson coil is structured to drive said drive rod, thereby moving said movable contact out of engagement with said stationary contact in less than 0.5 milliseconds after said Thomson coil is initially actuated, and wherein each said component comprises a first end portion and a second end portion disposed opposite and distal the first end portion; wherein the first end portion is coupled to said drive rod; and wherein the second end portion is pivotably coupled to said enclosure;

wherein said component pivots about the second end portion when said drive rod drives said movable contact into and out of engagement with said stationary contact;

wherein each of said plurality of toggle assemblies further comprises a plate member coupled to said component and disposed between the first end portion and said biasing element in order to allow said biasing element to bias said drive rod;

wherein said biasing element is a spring; and wherein said component extends through said spring and said plate member.

13. The vacuum switching apparatus of claim 12 wherein said drive rod has a third position between the first and second positions; and wherein, when said drive rod is in the third position, each said biasing element applies the bias to said drive rod in a direction perpendicular to the longitudinal axis.

14. The vacuum switching apparatus of claim 12 wherein, when said drive rod is in the first position, each said biasing element biases said drive rod toward the first position.

15. The vacuum switching apparatus of claim 14 wherein, when said drive rod is in the second position, each said biasing element biases said drive rod toward the second position.

* * * * *